US007208708B2

(12) United States Patent
Nagahira et al.

(10) Patent No.: US 7,208,708 B2
(45) Date of Patent: Apr. 24, 2007

(54) IMAGE HEATING APPARATUS HAVING FIRST AND SECOND ELECTROCONDUCTIVE LAYERS HAVING DIFFERENT RESISTANCE CHARACTERISTICS

(75) Inventors: Joji Nagahira, Yokohama (JP); Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/397,682

(22) Filed: Apr. 5, 2006

(65) Prior Publication Data

US 2006/0237445 A1 Oct. 26, 2006

(30) Foreign Application Priority Data

Apr. 12, 2005 (JP) ..... 2005-114745

(51) Int. Cl.
*H05B 6/14* (2006.01)
*H05B 6/06* (2006.01)
*G03G 15/20* (2006.01)

(52) U.S. Cl. ..... 219/619; 219/663; 219/667; 399/328; 399/330

(58) Field of Classification Search ..... 219/619, 219/647, 661–667; 399/328–338
See application file for complete search history.

(56) References Cited

U.S. PATENT DOCUMENTS 6,801,727 B2 10/2004 Maruyama et al. ..... 399/45
6,853,393 B2 2/2005 Akita ..... 347/129
6,937,828 B2 8/2005 Hasegawa et al. ..... 399/69
7,024,144 B2 4/2006 Akita et al. ..... 399/328
7,050,748 B2 5/2006 Akita et al. ..... 399/328
2002/0092846 A1* 7/2002 Yamamoto et al. ..... 219/619
2005/0074248 A1 4/2005 Akita et al. ..... 399/45
2005/0135827 A1 6/2005 Akita et al. ..... 399/69
2006/0062609 A1* 3/2006 Kinouchi et al. ..... 399/328

FOREIGN PATENT DOCUMENTS

JP 10-74009 3/1998
JP 2002-260836 9/2002
JP 2003-123957 4/2003
JP 2003-347030 12/2003

* cited by examiner

*Primary Examiner*—Philip H. Leung
(74) *Attorney, Agent, or Firm*—Fitzpatrick, Cella, Harper & Scinto

(57) ABSTRACT

An image heating apparatus for heating an image on a recording material by heat generation of a heating member includes a coil configured to generate a magnetic flux by energization a heat generation member having an electroconductive layer that generates heat by magnetic flux for heating an image on a recording material and, a frequency switching device for switching a frequency of a current supplied to the coil. The electroconductive layer includes a first electroconductive member at a central portion thereof and a second electroconductive member at an end portion thereof. The first electroconductive member has a resistence characteristic, with respect to the frequency of the current supplied to the coil, different from that of the second electroconductive member.

8 Claims, 9 Drawing Sheets

IMAGE HEATING APPARATUS HAVING FIRST AND SECOND ELECTROCONDUCTIVE LAYERS HAVING DIFFERENT RESISTANCE CHARACTERISTICS

FIELD OF THE INVENTION AND RELATED ART

The present invention relates to an image heating apparatus for heating or preliminarily fixing an image on a recording material or imparting gloss through heating. Particularly, the present invention relates to an induction heating-type image heating apparatus suitable for a fixation apparatus in an image forming apparatus such as a copying machine, a printer, a facsimile apparatus, etc., of an electrophotographic type.

In order to obtain a higher quality image in an image heating apparatus, the image heating apparatus is required to prevent an irregularity in temperature of a heating roller in a longitudinal direction of the heating roller. A temperature distribution in the longitudinal direction of the roller is changed depending on a situation of heating operation of a recording material, such as an initial stage of heating. For this reason, in order to further uniformize a temperature of the roller, the image heating apparatus is required to permit a heat generation distribution depending on the heating operation situation. More specifically, due to a larger amount of heat dissipation of the roller in the longitudinal direction at an end portion compared with that at a central portion, a decrease in temperature at the roller end portion is caused to occur, so that it is necessary to increase an amount of heat generation at the roller end portion. On the other hand, it is necessary to suppress the amount of heat generation at the roller end portion corresponding to a non-sheet-passing portion when a recording material having a small width is passed through the roller. In other words, the image heating apparatus has been required to compatibly solve contradictory problems including a prevention of a decrease in end portion temperature and a prevention of temperature rise at the non-sheet-passing portion.

In order to solve these problems, as a conventional fixation apparatus of an induction heating type, Japanese Laid-Open Patent Application (JP-A) Hei 10-74009 and JP-A 2003-123957 have proposed such a constitution that a magnetic flux blocking means for blocking a part of magnetic flux from an exciting coil to a metal sleeve as a heating member which generates heat by (electro-)magnetic induction heating is disposed between the metal sleeve and the exciting coil and is changed in position by displacing means depending on a sheet-passing range of the metal sleeve, thus performing blocking of magnetic flux in an arbitrary width in the longitudinal direction of the metal sleeve. As a result, it is possible to control a thermal distribution of the metal sleeve to be increased in temperature, irrespective of a size of a transfer material to be conveyed.

However, such a constitution proposed by JP-A Hei 10-74009 and JP-A 2003-123957 requires an additional driving apparatus for driving the magnetic flux blocking means, thus being accompanied with an increase in number of parts of the fixation apparatus.

In order to solve the above described problems without increasing the number of parts of the fixation apparatus, e.g., JP-A 2002-260836 has proposed a fixation apparatus which includes a heating roller provided with a cylindrical electroconductive layer of an electroconductive material formed in a layer thickness t1 in the neighborhood of both end portions in an axial (line) direction of the electroconductive layer and in a layer thickness t2, larger than t1, at other portions of the electroconductive layer and includes a magnetic field generation means for generating applying a magnetic field generation means for generating applying a magnetic field to the electroconductive layer so as to generate heat. In the fixation apparatus, when a large-size material to be heated is heated, a fixation of an alternating magnetic field is set to be high to generate heat on such a condition that a surface layer has a layer thickness (depth) of t1, whereby a temperature rise rate and a temperature distribution over the entire electroconductive layer in an axial direction of the roller. When a small-size material to be heated is heated, the frequency of the alternating magnetic field is set to be low to generate heat principally at a portion of the electroconductive layer formed in a layer thickness of t2, whereby heat generation at the portion formed in the layer thickness of t1 is suppressed.

However, the fixation apparatus proposed in JP-A 2002-260836 has been accompanied with a problem of an occurrence of an irregularity in temperature in a longitudinal direction of the roller due to a thickness distribution of the roller in the longitudinal direction. Particularly, in the case where a difference in heat generation distribution in the longitudinal direction of the roller is intended to be increased, the roller is required to be increased in thickness distribution in the roller longitudinal direction. As a result, there has arisen a problem that the temperature irregularity is noticeable.

JP-A 2003-347030 has proposed a method wherein a heat generation distribution in a roller longitudinal direction is created without increasing a thickness distribution of the roller. In this method, in order to prevent a lowering in temperature at a roller end portion, a high-resistance portion is provided at an end portion of the roller in the roller longitudinal direction to always realize an amount of heat generation at the end portion larger than that at a central portion, so that the heat generation distribution in the roller longitudinal direction is adjusted to uniformize the temperature of the roller.

However, in the method proposed in JP-A 2003-347030, the adjusted heat generation distribution is constant, so that the heat generation distribution is not changeable depending on use conditions. For this reason, the method is advantageous for the prevention of the temperature lowering at the roller end portion but to the contrary the method is disadvantageous for prevention of toner rise at a non-sheet-passing portion, i.e., at the end portion of the roller. In other words, it is impossible to compatibly realize the prevention of toner lowering at the roller end portion and the prevention of temperature rise at the non-sheet-passing portion.

SUMMARY OF THE INVENTION

An object of the present invention is to provide an induction heating-type image heating apparatus capable of changing a heat generation member perpendicular to a recording material conveyance direction without increasing not only the number of parts and a thickness distribution of a roller.

According to an aspect of the present invention, there is provided an image heating apparatus, comprising:

magnetic flux generation means having an exciting coil;

an image heating member, having a heat generation portion which generates heat by magnetic flux from the magnetic flux generation means, for heating an image on a recording material; and change means for changing a frequency of a current to be supplied to the exciting coil;

wherein the heat generation portion has a first area provided with a first heat generation member and a second area provided with a second heat generation member, the first area and the second area being disposed at longitudinally different portions, and the heat generation portion has a ratio of an amount of heat generation per unit volume of the second heat generation member to an amount of heat generation per unit volume of the first heat generation member, the ratio varying depending on the frequency.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described more specifically based on embodiments with reference to the drawings but is not limited to these embodiments.

Embodiment 1

(1) Explanation of Image Forming Apparatus

Figure 1:
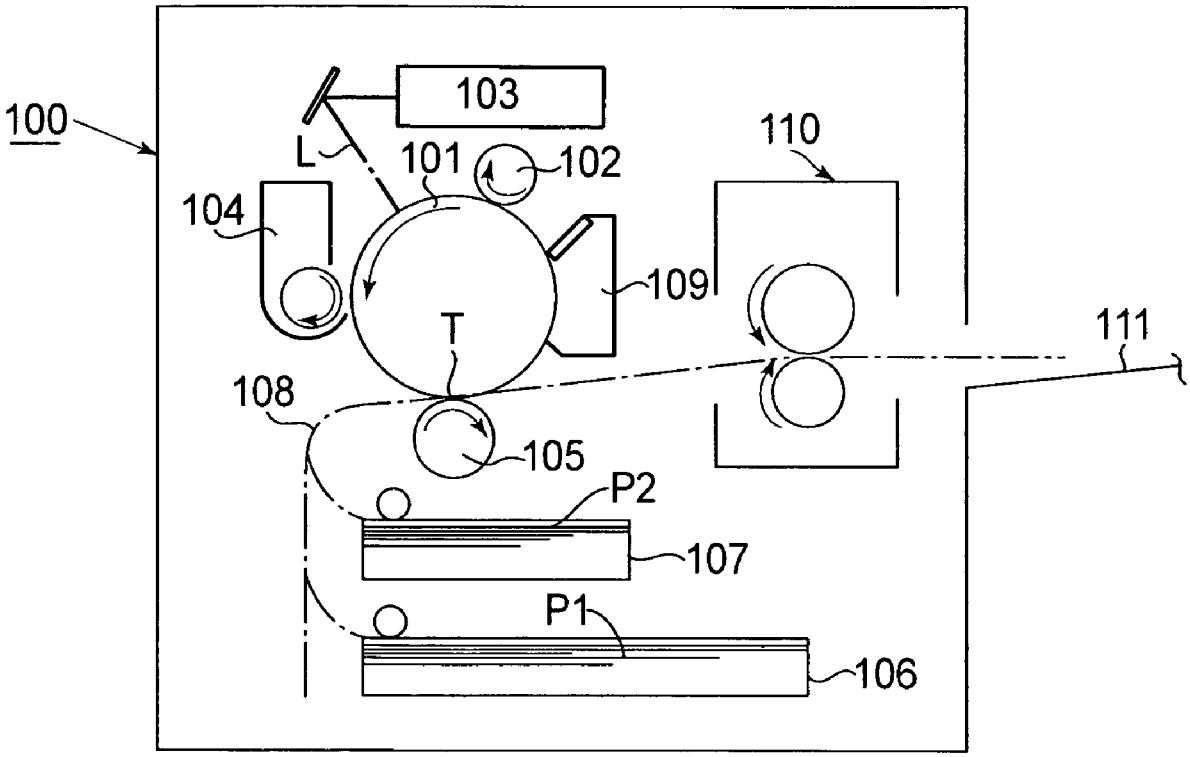
FIG. 1 is a schematic structural view of an image forming apparatus in Embodiment 1.

FIG. 1 is a schematic structural view of an embodiment of an image forming apparatus 100 provided with an image heating apparatus of an induction heating-type according to the present invention as an image heating fixing apparatus 110. In this embodiment, the image forming apparatus 100 is a printer of a laser scanning exposure type utilizing a transfer-type electrophotographic process.

An electrophotographic photosensitive member 101 of a rotation drum-type as an image bearing member (hereinafter referred to as a "photosensitive drum") is rotationally driven in a counterclockwise direction of an arrow indicated therein in FIG. 1 at a predetermined peripheral speed. The photosensitive drum 101 is electrically charged uniformly to a predetermined polarity and a predetermined potential. The photosensitive drum 101 is subjected to image exposure L by an image writing apparatus 103 at the uniformly charged surface thereof, whereby a potential at an exposure light portion at the uniformly charged surface is attenuated to form an electrostatic latent image corresponding to an exposure pattern at the surface of the photosensitive drum 101. In this embodiment, the image writing apparatus 103 is a laser (beam) scanner and outputs laser light modulated in accordance with image data, so that the uniformly charged surface of the rotating photosensitive drum 101 is scan-exposed to light to form thereon an electrostatic latent image corresponding to original image information.

Then, the electrostatic latent image is developed with toner as a toner image by a developing apparatus 104. The toner image is electrostatically transferred onto a recording material (transfer material) as a recording medium, at a position of a transfer charging apparatus 105, fed at a predetermined control timing from a sheet feeding mechanism portion to a transfer portion T which an opposite portion between the photosensitive drum 101 and the transfer charging apparatus 105.

The sheet feeding mechanism portion includes, in the case of the image forming apparatus in this embodiment, a first cassette sheet feeding portion 106 containing stacked sheets of a large-size recording material P1, a second cassette sheet feeding portion 107 containing stacked sheets of a small-size recording material P2, and a recording material feeding path 108 for feeding the recording material P1 or P2 selectively separated one by one from the stacked sheets in the first or second cassette sheet feeding portion 106 or 107 to the transfer portion T at a predetermined timing.

The recording material P1 or P2 onto which the toner image is transferred from the surface of the photosensitive drum 101 at the transfer portion T is separated from the photosensitive drum 101 and conveyed to a fixing apparatus 110 by which an unfixed toner image on the recording material is subjected to a fixing process and the recording material is discharged on a discharge tray 111 provided outside the image forming apparatus.

On the other hand, the surface of the photosensitive drum 101 after separation of the recording material is subjected to removal of deposited contaminant such as transfer residual toner or the like to be cleaned by a cleaning apparatus 109, thus being repetitively subjected to image formation.

(2) Fixing Apparatus 110

Figure 2:
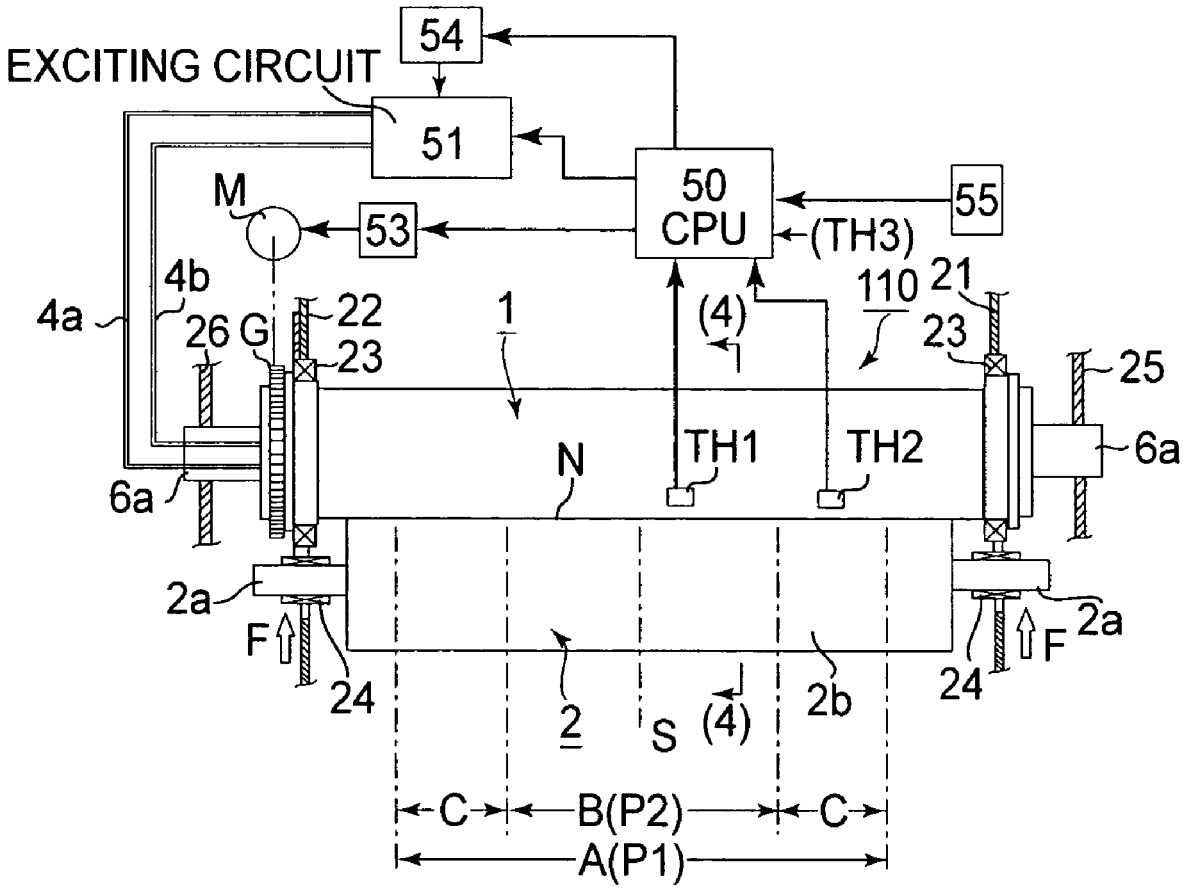
FIG. 2 is a schematic front view of a principal portion of a fixing apparatus.
Figure 3:
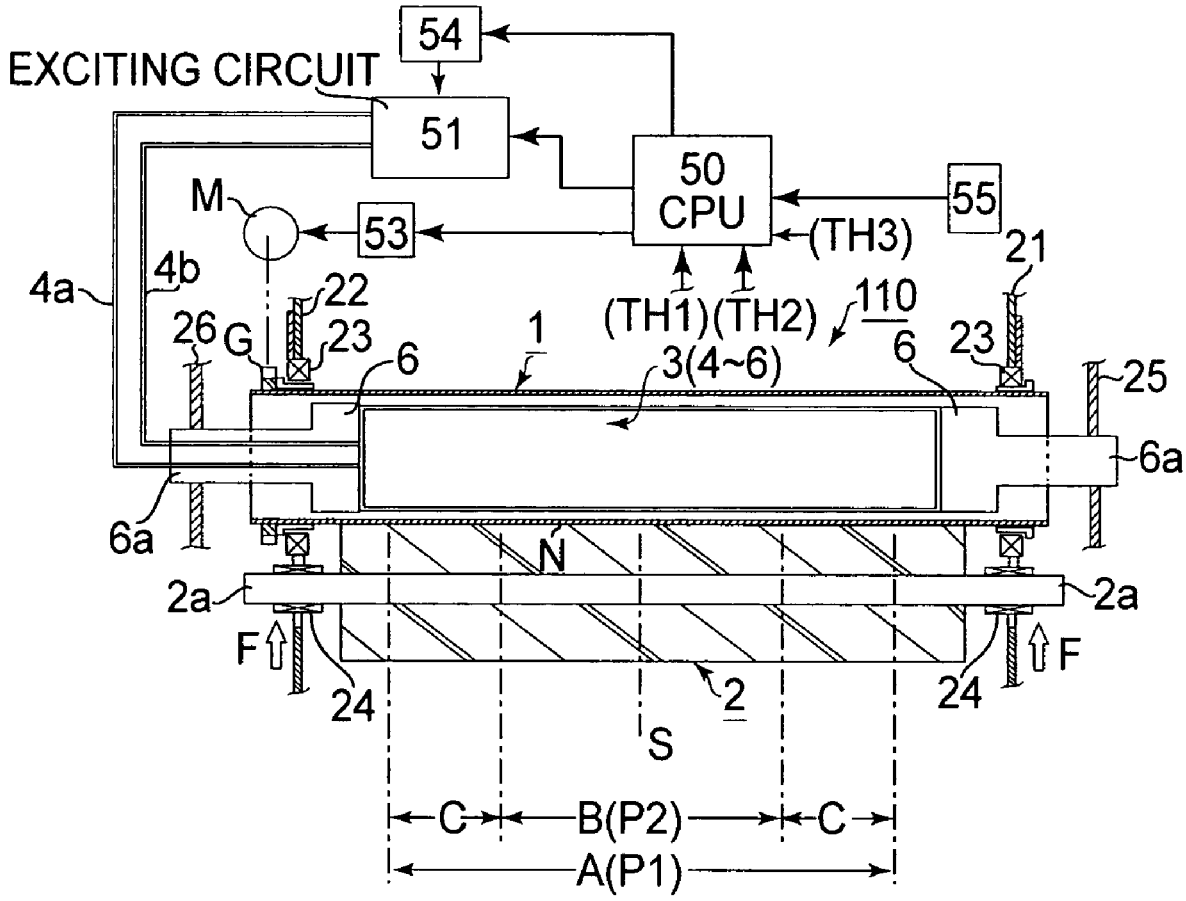
FIG. 3 is a schematic longitudinal sectional (front) view of the principal portion of the fixing apparatus.
Figure 4:
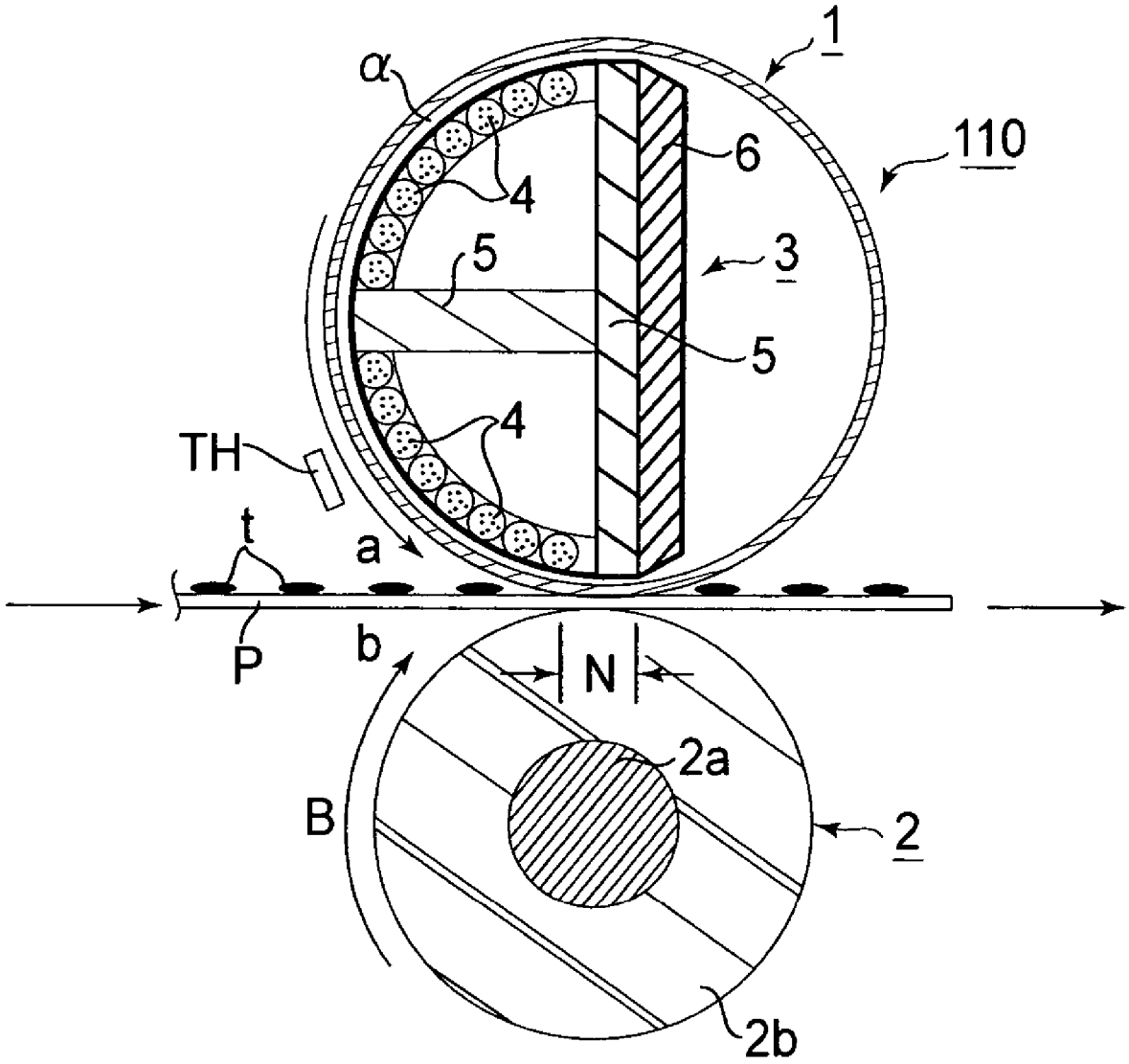
FIG. 4 is a schematic cross-sectional view taken along a line (4)—(4) indicated in FIG. 2.

FIG. 2 is a schematic front view of a principal portion of the fixing apparatus 110; FIG. 3 is a schematic longitudinal sectional view of the principal portion of the fixing apparatus 100; and FIG. 4 is a schematic cross sectional view taken along a line (4)–(4) indicated in FIG. 2. The fixing apparatus 100 is of a heat roller-type and is an induction heating-type image heating apparatus.

The fixing apparatus 110 includes a fixation roller 1 (rotation member for heating) as a heat generation member for generating heat by induction heating and a pressure roller 2 as a pressing member.

The fixation roller 1 is a cylindrical roller having a metal layer and is disposed so that both end portions thereof are rotatably supported between front and rear side plates 21 and 22, through bearings 23, which are located at front and rear sides of an apparatus chassis.

At the surface of the fixation roller 1, it is also possible to provide an elastic layer or release layer formed of rubber, fluorine-containing resin, etc.

The pressure roller 2 is constituted by a core metal 2*a* and a heat-resistant elastic layer 2*b*, concentrically formed integrally in a roller shape with the core metal 2*a*, formed of silicone rubber, fluorine-containing rubber, fluorine-containing resin, etc. The pressure roller 2 is disposed below the above-described fixation roller 1 so that both end portions of the core metal 2*a* are rotatably supported between the front and rear side plates 21 and 22 through bearings 24. Further, the pressure roller 2 is disposed in pressure contact with a lower surface of the fixation roller 1 by an unshown urging means at a predetermined pressing force F, so that the heat-resistant elastic layer 2*b* of the pressure roller 2 is deformed with resistance to elasticity at the pressure contact portion with the fixation roller 1 to form a fixation nip portion N with a predetermined width as a recording material heating portion between the pressure roller 2 and the fixation roller 1. In the case where the fixation roller 1 possesses low stiffness to provide an insufficient pressing force, it is possible to obtain a predetermined pressing force with respect to the lower surface of the fixation roller 1 by using a pressure stay at an inner surface of the fixation roller 1.

Inside the hollow fixation roller 1, an exciting coil assembly 3 as a magnetic field generation means is inserted and disposed. The exciting coil assembly 3 an elongated assembly member comprising an exciting coil (induction coil) 4, a magnetic core (exciting iron core) 5 having a T-shaped longitudinal cross section, an insulating holder 6, etc. The exciting coil assembly 3 is inserted into the fixation roller 1 and is placed in such a state that it is held in a predetermined angular position at the inner surface of the fixation roller 1 in a noncontact manner with a predetermined gap a between the inner surface of the fixation roller 1 and the exciting coil 4. In such a state, the exciting coil assembly 3 is disposed so that holder extension portions 6*a* and 6*a* outwardly protruded from both end portions of the fixation roller 1 are nonrotationally fixed and supported between front and rear fixing members 25 and 26 of the fixing apparatus.

The exciting coil 4 comprises Litz wire (copper wire) prepared as core wire by making bundles of roughly 80–160 strands of fine wires each having a diameter of approximately 0.1–0.3 mm. As the fine wires, an insulating coating electric cable is used. The Litz wire is wound around the magnetic core 5 plural times along the inner surface shape of the fixation roller 1 in an elongated boat form, thus providing the exciting coil 4. The magnetic core 5 is formed of a magnetic material as, e.g., a ferrite core or a lamination core. The magnetic core 5 is disposed so as to be perpendicular to the Litz wire of the exciting coil 4, thus creating a magnetic path (circuit).

To a fixation roller drive gear G fixed at the rear end portion of the fixation roller 1, a rotation force is transmitted from a driving source M through a power transmitting system (not shown), whereby the fixation roller 1 is rotationally driven in a counterclockwise direction indicated by an arrow a shown in FIG. 4 at a predetermined speed. The pressure roller 2 is rotated by the rotational drive of the fixation roller 1 in a clockwise direction indicated by an arrow b shown in FIG. 4. It is also possible to configure the pressure roller as a drive roller.

Two lead wires 4*a* and 4*b* of the above described exciting coil 4 are connected to an exciting circuit (coil drive power source) 51 for passing a high-frequency current through the exciting coil 4.

A first (main) temperature detection element TH1 and a second (sub) temperature detection element TH2 are thermistors or the like for detecting a temperature of the fixation roller 1 and are independently disposed in contact or noncontact with the fixation roller 1. More specifically, the first temperature detection element TH1 is disposed at a position corresponding to a sheet-passing area B of a small-size recording material P2 described later. The second temperature detection element TH2 is disposed at a position corresponding to a non-sheet-passing area C of the small-size recording material P2 described later.

A main assembly control circuit portion (CPU) 50 performs an overall image forming operation sequence of the image forming apparatus. Information on fixation roller detection temperatures of the above described temperature detection elements TH1 and TH2 is inputted into the main assembly control circuit portion 50. Further, the main assembly control circuit portion 50 performs ON/OFF control of the above described drive power source M, ON/OFF control of the above described exciting circuit 51, and control of a frequency control portion (frequency control means) for switching a frequency of the high-frequency current to be passed through the exciting coil 4 by the exciting circuit 51.

Into the main assembly control circuit portion 50, information on the size of a recording material to be used and passed through the fixation apparatus is inputted from size selection and designation means 55 for selecting and designating the size of a recording material P to be used.

The main assembly control circuit portion 50 starts predetermined image forming sequence control on the basis of turning on of a main power switch of the fixation apparatus or input of a print start signal. In the fixing apparatus 11, the fixation roller 1 is started to be rotated by turning the driving power source M on. Further, from the exciting circuit 51, a high-frequency current at a predetermined frequency is caused to be passed through the exciting coil 4, whereby an alternating magnetic field (high-frequency alternating magnetic flux) is generated around the exciting coil 4. As a result, a high-frequency induction current (eddy-current) is induced in the induction heat generation member of the fixation roller 1, so that the fixation roller 1 is heated due to magnetic induction heating. A temperature of the fixation roller 1 is detected by the first and second temperature detection elements TH1 and TH2 and resultant temperature information is inputted into the main assembly control circuit portion 50 through an A/D converter. The main assembly control circuit portion 50 temperature-controls the fixation roller 1 by controlling power supplied from the exciting circuit 51 to the exciting coil 4 so that the fixation roller temperature inputted from the first temperature detection element TH1 is kept at a predetermined optimum temperature (fixing temperature).

As an example of control of supplied electric power, the main assembly control circuit portion 50 controls the temperature of the fixation roller 1 at an optimum temperature by increasing an ON/OFF duty of the exciting circuit 51 to increase electric power supplied from the exciting circuit 51 to the exciting coil 4 when the temperature detected by TH1 is lower than the optimum temperature and by decreasing the ON/OFF duty of the exciting circuit 51 to decrease electric power supplied from the exciting circuit 51 to the exciting coil 4 when the temperature detected by TH1 is higher than the optimum temperature.

Then, in such a state that the temperature of the fixation roller 1 is increased and controlled at a predetermined temperature, the recording material P carrying thereon the unfixed toner image t is introduced from the image forming portion into the fixation nip portion N and is conveyed through the fixation nip portion N while being sandwiched between the fixation roller 1 and the pressure roller 2. As a result, the unfixed toner image t is heat-fixed on the surface of the recording material P by heat of the fixation roller 1 and pressure at the fixation nip portion N.

Figure 5:
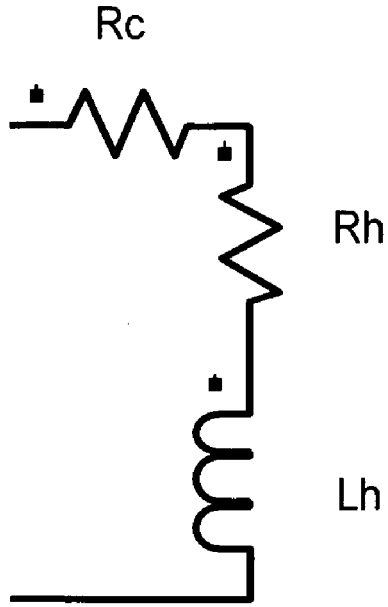
FIG. 5 is an equivalent circuit diagram of an induction heating fixing apparatus viewed from an exciting coil side.

FIG. 5 shows an equivalent circuit of the induction heating-type fixing apparatus viewed from both ends of the exciting coil 4, i.e., an exciting coil-based equivalent circuit. Referring to FIG. 5, the equivalent circuit includes a resistance Rc of the exciting coil 4 alone, a resistance Rh by electromagnetic connection between the exciting coil 4 and the fixation roller 1, and an inductance Lh by electromagnetic connection between the exciting coil 4 and the fixation roller 1.

In this equivalent circuit, Rh+Rc and Lh are obtained as a resistive component and an inductance component of an impedance characteristic (a series LR equivalent circuit) by an LCR meter and an impedance analyzer. In other words, Rh+Rc is obtained as the resistive component of the impedance characteristic (the series LR equivalent circuit) as viewed from the exciting coil 4 of the induction heating-type fixing apparatus.

Further, Rc is obtained as a resistive component of the impedance characteristic (the series LR equivalent circuit) as viewed from the exciting coil 4 in a state in which the fixation roller 1 is removed from the induction heating-type fixing apparatus.

Rh is obtained as a difference between a result of measurement of Rh+Rc and a result of measurement of Rc.

When a current passes through the circuit, a product of the sequence of the current and a resistance value is consumed as an effective electric power to penetrate heat. The exciting coil 4 is caused to generate heat by the electric power consumed by Rc and the fixation roller 1 is caused to generate heat by the electric power consumed by Rh.

(3) Countermeasure to Temperature Rise at Non-Sheet-Passing Portion

In the fixing apparatus of this embodiment, sheet passing (conveyance in the apparatus) of the recording material P is performed on a center line basis with a center line of the recording material in its width direction as a reference line. In FIGS. 2 and 3, S represents a referential center line. Here, a size width with respect to the recording material means a dimension of a width of the recording material in a direction perpendicular to a recording material conveyance direction in a plane of the recording material. In FIGS. 2 and 3, A represents a sheet-passing area of a recording material P1, having a maximum size width, capable of being passed through the apparatus. Hereinafter, the recording material P1 having a size width corresponding to the sheet-passing area A is referred to as a "large-size recording material". Further, B represents a sheet-passing area of a recording material P2 having a size width smaller than the large-size recording material P1. Hereinafter, the recording material P2 having a size width corresponding to the sheet-passing area B is referred to as a "small-size recording material". C represents a non-sheet-passing area which is an area of a difference between the sheet-passing area A of the large-size recording material P1 and the sheet-passing area B of the small-size recording material P2. In this embodiment, sheet passing of the recording materials P1 and P2 is performed on the center line basis, so that a non-sheet-passing area is caused to be created at each of both side portions of the sheet-passing area B of the small-size recording material P2.

As described above, the first temperature detection element TH1 is disposed so as to detect the temperature of the fixation roller P corresponding to the sheet-passing area B of the small-size recording material P2, so that temperature control of the fixation roller 1 is performed. For this reason, when the sheet passing of the small-size recording material P2 is continuously performed, the temperature of the fixation roller portion corresponding to the sheet-passing area B of the small-size recording material P2 is controlled and kept at a predetermined fixing temperature but the temperature of the fixation roller portion corresponding to the non-sheet-passing area C exceeds the predetermined fixing temperature and is excessively increased (temperature rise at the non-sheet-passing portion) since heat of the fixation roller portion is not consumed for heating the recording material or the toner image and thus is stored.

In this embodiment, in order to suppress such a non-sheet-passing portion temperature rise phenomenon and allow efficient control of thermal distribution and electric power supply with good heat generation efficiency, the fixing apparatus is provided with a frequency control portion 54 as a frequency control means (change means) for switching (changing) a frequency of alternating current caused to flow from the exciting circuit 51 to the exciting coil 4. By controlling the frequency control portion 54 by means of the main assembly control circuit portion 50 depending on size information, of the recording material to be used and passed through the fixing apparatus, inputted from the recording material size selection and designation means 55 into the main assembly control circuit portion 50, switching of the frequency of the alternating current caused to flow from the exciting circuit 51 to the exciting coil 4 is effected. Further, the fixation roller 1 (the cylindrical roller having the metal layer) as the heating member which generates heat by magnetic induction heating is configured so that a plurality of heat generation member portions different in heat generation density by the above-described frequency switching by means of the frequency control portion 54 in the longitudinal direction of the fixation roller 1 perpendicular to the recording material conveyance direction. Specific embodiments thereof are described below.

1) Specific Embodiment 1

Figure 6:
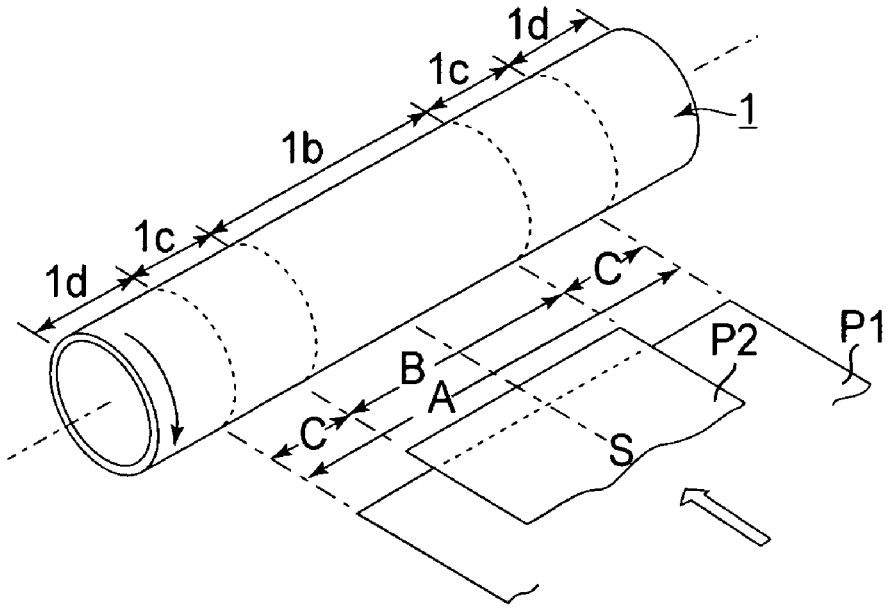
FIG. 6 is an explanatory view of portions of a fixing roller corresponding to a sheet-passing portion and a non-sheet-passing portion.

In FIG. 6, a fixation roller 1 as an image heating member includes a fixation roller portion 1*b* corresponding to a sheet-passing area B of a small-size recording material P2, a fixation roller portion 1*c* corresponding to a non-sheet-passing area C which is an area of a difference between a sheet-passing area A of a large-size recording material P1 and the sheet-passing area B of the small-size recording material P2 in the case of passing the small-size recording material P2 through the fixing apparatus, and an fixation roller extension portion 1*d* located outside the fixation roller portion 1*c* in the longitudinal direction (perpendicular to the recording material conveyance direction) of the fixation roller 1.

An alternating magnetic field generated in the exciting coil assembly 3 as the magnetic flux generation means (magnetic field generation means) disposed inside the fixation roller 1 acts on a range of the fixation roller portions 1*b*+1*c*. This range (1*b*+1*c*) of the fixation roller 1 is a range substantially heated due to magnetic induction heating. On the fixation roller extension portion 1*d*, the alternating magnetic field of the exciting coil assembly 3 does not act substantially. Accordingly, the fixation roller extension portion 1*d* is a non-heating range portion.

2) Specific Embodiment 2

Figure 7:
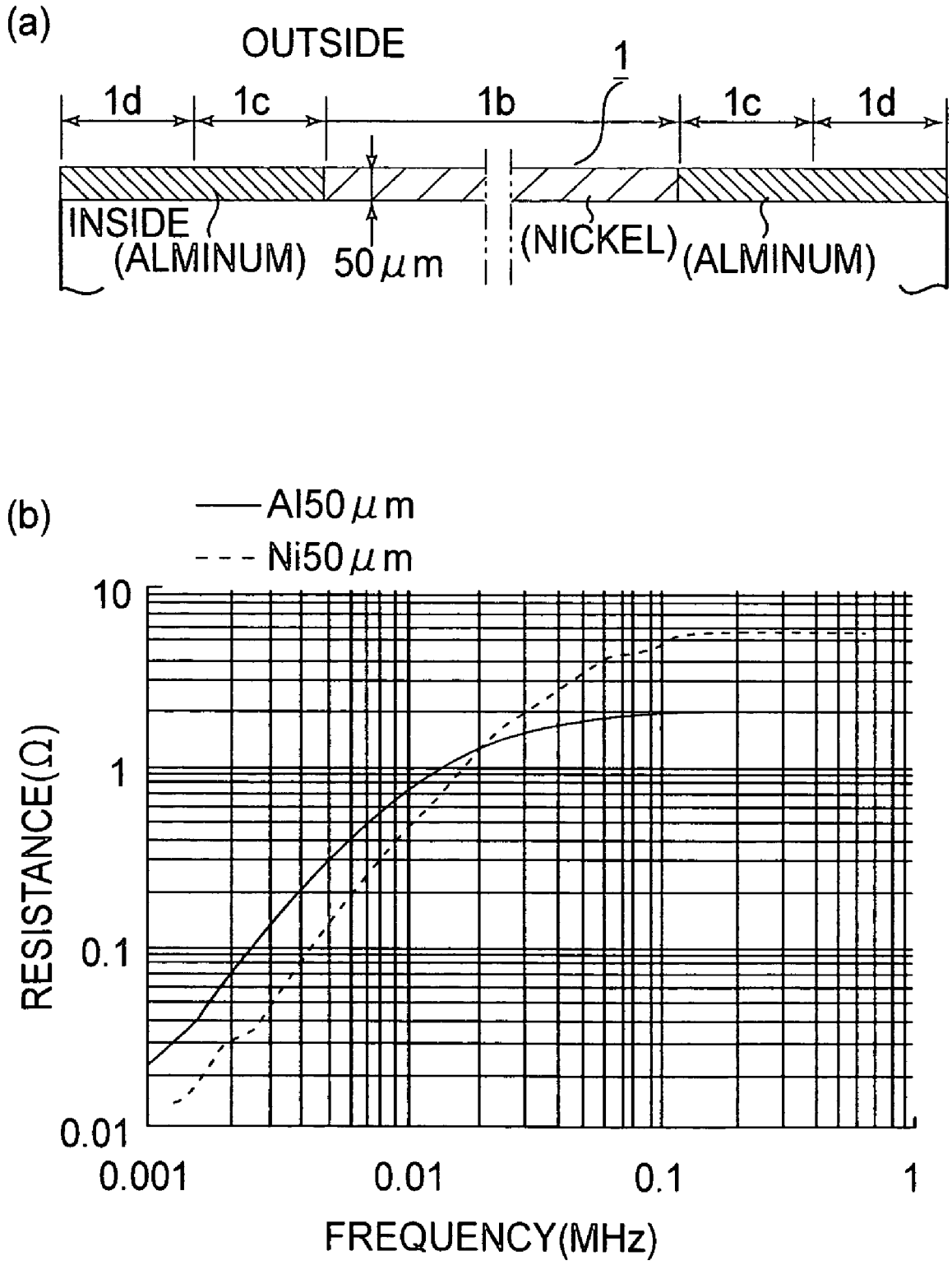
FIGS. 7(*a*) and 7(*b*) are explanatory views showing an embodiment of the fixing roller.

In this specific embodiment, as shown in FIG. 7(*a*) showing a schematic view of a fixation roller 1 in a longitudinal direction thereof, the fixation roller 1 includes a 50 μm-thick metal layer of nickel as a fixation roller portion 1*b* (heat generation portion) and 50 μm-thick metal layers of aluminum as fixation roller portions 1*c* and 1*d* (heat generation portions). In other words, the fixation roller portions 1*b*, 1*c*, and 1*d* of the fixation roller 1 are the metal layers which have the same thickness but are formed of metal materials different in electroconductivity between the fixation roller portion 1*b* and the fixation roller portions 1*c* and 1*d*.

FIG. 7(*b*) shows a result of measurement of resistances Rh of magnetic induction heat generation members (of nickel (Ni) and aluminum (Al)) which have the same thickness but are formed of metal materials different in electroconductivity.

When the size information of the recording material used for sheet passing inputted from the recording material size selection and designation means 55 in the large-size recording material P1, the main assembly control circuit portion 50 controls the frequency control portion 54 so that the frequency of the alternating current caused to flow from the exciting circuit 51 to the exciting coil 4 is changed to about 20 kHz. As a result, the resistances Rh of the fixation roller portions 1*b* and 1*c* of the fixation roller 1 are substantially identical to each other, and thus heat generation densities (an amount of heat generation per unit volume of each heat generation portion which actually generates heat) of the fixation roller portions 1*b* and 1*c*, of the fixation roller 1, which generate heat due to magnetic induction are also substantially identical to each other, so that it is possible to uniformize heat supply from the fixation roller 1 to the large-size recording material P1 in the longitudinal direction of the fixation roller 1. In other words, it is possible to uniformize a thermal distribution over the entire fixation roller portions 1*b*+1*c* corresponding to the sheet-passing area A of the large-size recording material P1.

When the size information of the recording material used for sheet passing inputted from the recording material size selection and designation means 55 in the small-size recording material P2, the main assembly control circuit portion 50 controls the frequency control portion 54 so that the frequency of the alternating current caused to flow from the exciting circuit 51 to the exciting coil 4 is changed to be higher than about 20 kHz. More specifically, the resistance Rh of the fixation roller portion 1*c* disposed in an area corresponding to the differential area between the conveyance area of the maximum size (large-size) recording material and the conveyance area of the small-size recording material P2 is lower than the resistance Rh of the fixation roller portion 1*b*, i.e., a ratio of the resistance Rh of the fixation roller portion 1*c* to the resistance Rh of the fixation roller portion 1*b* is decreased, so that an amount (rate) of heat generation per unit length of the fixation roller portion 1*c* in the longitudinal direction of the fixation roller 1 is smaller than an amount (rate) of Meat generation per unit length of the fixation roller portion 1*b* in the longitudinal direction of the fixation roller 1. As a result, it is possible to suppress temperature rise at the non-sheet-passing portion.

Further, the fixation roller 1 has an amount of heat dissipation higher at end portions than at a central portion, so that the fixation roller 1 is accompanied with such a problem that the temperature of the fixation roller 1 is lower at the end portions than at the central portion. In this case, the frequency is set so that the heat generation amount at the end portions is larger (i.e., so that the ratio of the resistance Rh at the fixation roller portion 1*c* to the resistance Rh at the fixation roller portion 1*b* is larger), whereby it is possible to uniformize the temperature of the fixation roller 1 and it is also possible to realize early temperature return.

3) Specific Embodiment 3

Figure 8:
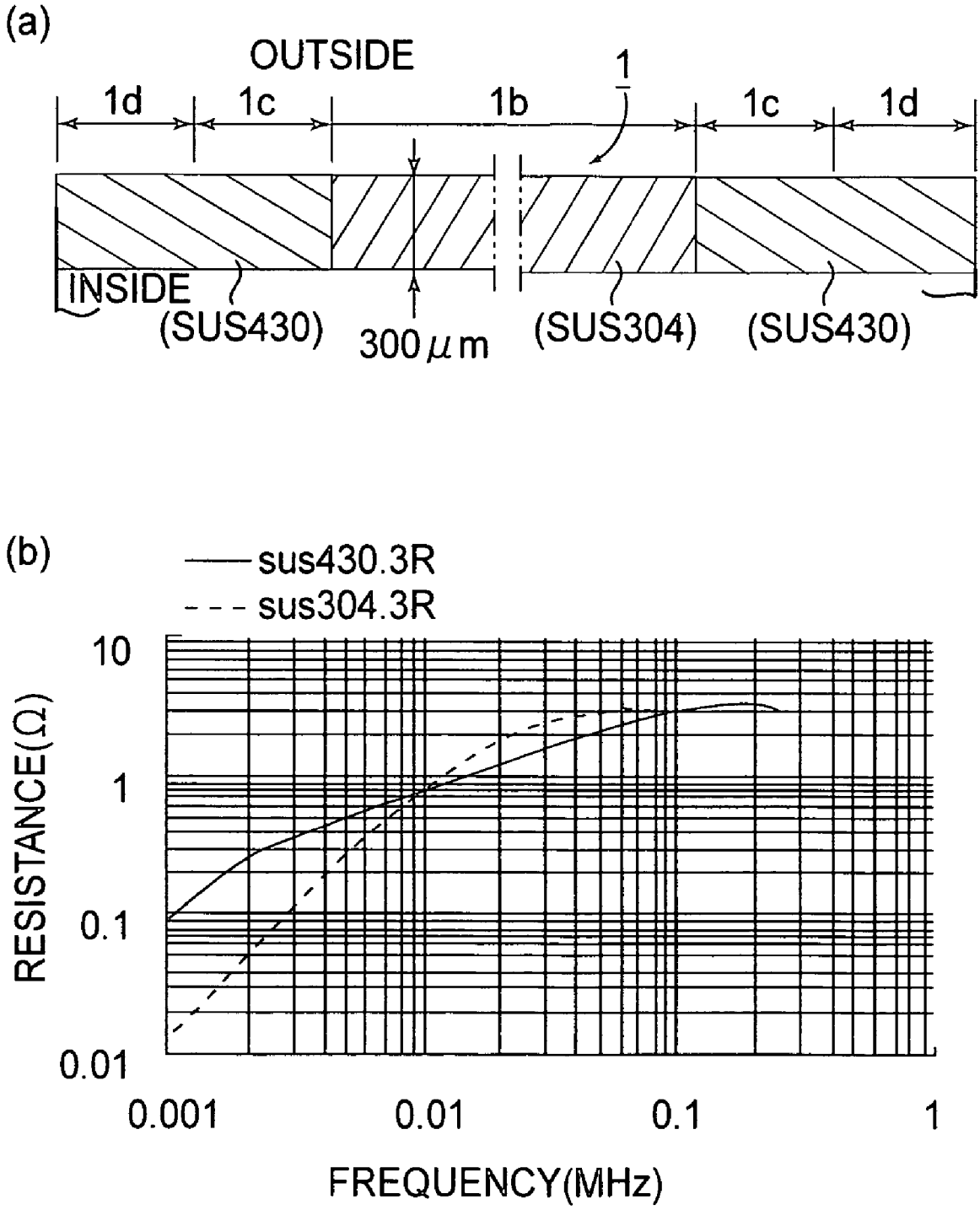
FIGS. 8(*a*) and 8(*b*) are explanatory views showing another embodiment of the fixing roller.

In this specific embodiment, as shown in FIG. 8(*a*) showing a schematic view of a fixation roller 1 in a longitudinal direction thereof, the fixation roller 1 includes a 300 μm-thick metal layer of SUS304 as a fixation roller portion 1*b* (heat generation portion) and 300 μm-thick metal layers of SUS430 as fixation roller portions 1*c* and 1*d*. In other words, the fixation roller portions 1*b*, 1*c*, and 1*d* of the fixation roller 1 are the metal layers which have the same thickness but are formed of metal materials different in permeability between the fixation roller portion 1*b* and the fixation roller portions 1*c* and 1*d*.

FIG. 8(*b*) shows a result of measurement of resistances Rh of magnetic induction heat generation members (of SUS304 and SUS430) which have the same thickness but are formed of metal materials different in permeability.

When the size information of the recording material used for sheet passing inputted from the recording material size selection and designation means 55 in the large-size recording material P1, the main assembly control circuit portion 50 controls the frequency control portion 54 so that the frequency of the alternating current caused to flow from the exciting circuit 51 to the exciting coil 4 is changed to about 8 kHz. As a result, the resistances Rh of the fixation roller portions 1*b* and 1*c* of the fixation roller 1 are substantially identical to each other, and thus heat generation densities of the fixation roller portions 1*b* and 1*c*, of the fixation roller 1, which generate heat due to magnetic induction are also substantially identical to each other, so that it is possible to uniformize heat supply from the fixation roller 1 to the large-size recording material P1 in the longitudinal direction of the fixation roller 1. In other words, it is possible to uniformize a thermal distribution over the entire fixation roller portions 1*b*+1*c* corresponding to the sheet-passing area A of the large-size recording material P1.

When the size information of the recording material used for sheet passing inputted from the recording material size selection and designation means 55 in the small-size recording material P2, the main assembly control circuit portion 50 controls the frequency control portion 54 so that the frequency of the alternating current caused to flow from the exciting circuit 51 to the exciting coil 4 is changed to be higher than about 8 kHz. As a result, the resistance Rh of the fixation roller portion 1*c* of the fixation roller 1 is lower than the resistance Rh of the fixation roller portion 1*b*, i.e., a heat generation density of the resistance Rh of the fixation roller portion 1*c* which generates heat due to magnetic induction is smaller than a heat generation density of the fixation roller portion 1*b*, so that the heat generation density corresponding to the non-sheet-passing area can be decreased. As a result, it is possible to suppress temperature rise at the non-sheet-passing portion.

More specifically, in the longitudinal direction of the fixation roller 1 as the heating member which generates heat due to magnetic induction, the plurality of fixation roller portions different in thickness, electroconductivity, or permeability is disposed and the fixation roller of a current caused to pass through the exciting coil is changed by the frequency control means, so that it is possible to relatively decrease the heat generation density of the fixation roller 1 in the non-sheet-passing area. Further, a path of magnetic flux (magnetic circuit) created between the exciting coil assembly 2 as the magnetic field generation means and the fixation roller 1 as the heating member which generates heat due to magnetic induction does not require a space for containing a magnetic flux blocking means. Further, it is possible to effect optimum electric power supply with good heat generation efficiency, irrespective of a sheet-passing mode of the large-size recording material or the small-size recording material, without impairing energy saving performance, so that it is possible to suppress temperature rise of the fixation roller 1 in the non-sheet-passing area.

In the fixation rollers 1 used in Specific Embodiments 2 (FIG. 7) and 3 (FIG. 8) described above and in Embodiment 2 (FIG. 9) described later, the different metal fixation roller portions 1*b* and 1*c* are connected with each other by welding.

Here, in advance of description as to the method of measuring the amount of heat generation per unit length in the longitudinal direction (verification method in the present invention), a frequency characteristic of apparent resistance Rh viewed from the exciting coil will be briefly described.

The frequency characteristic of Rh is associated with the square of a frequency f in a low-frequency area, e.g., as shown in FIG. 7(*b*) in the case where the roller thickness in smaller than a depth (thickness) of the surface layer and the frequency characteristic of Rh (heat generation characteristic of the heat generation member) is not affected by the skin effect, and comes closer to a certain value as the frequency is increased. On the other hand, in the case where the roller thickness is larger than a depth (thickness) of the surface layer and the frequency characteristic of Rh is affected by the skin effect, the frequency characteristic of Rh is associated with the square root of the frequency f when the frequency is increased as shown in an example of SUS430 of FIG. 8(*b*). In other words, the frequency characteristic of Rh can have three kinds of change points such that the frequency is changed from the square of f to the certain value or the square root of f and is changed from the certain value to the square root of f.

Further, when the resistance Rh is measured in such a state that the coil is oppositely disposed while extending in the longitudinal direction of the fixation roller formed of the different materials, the resultant frequency characteristic of Rh is obtained as a curve determined by the sum of each of the different materials alone.

Based on the above described factors, the verification method in the present invention will be described.

More specifically, a method of verifying whether or not the heat generation distribution is controlled to be a desired distribution by switching the frequency can be performed in the following manner.

The amount of heat generation is proportional to the resistance Rh, so that the amount of heat generation is indirectly determined by measuring the resistance Rh. Thus, by switching the frequency, a ratio of Rh between the different materials only have to be confirmed that it is controlled so as to be a predetermined ratio.

However, Rh is changed when measuring conditions (e.g., positions of materials to be measured and a coil to be measured, a shape of coil, the number of winding of coil, etc.) even when the materials to be measured are identical.

Accordingly, measuring conditions of respective materials to be independently subjected to measurement of Rh are required to be optimized so that the frequency characteristic of Rh (resistance) of each of the respective materials measured alone is reflected in the frequency characteristic of Rh measured when the fixation roller is mounted in the fixing apparatus.

The optimization of the measuring conditions is performed in the following manner.

The frequency characteristic of the resistance Rh of the heat generation member viewed from the coil of the fixing apparatus when the heat generation member is actually incorporated into the fixing apparatus is measured to determine change points. Next, the frequency characteristic of Rh of each of different materials is measured by means of an arbitrary measuring coil, and then positions of the measuring coil and the heat generation member and the shape of the measuring coil may be adjusted so that the change points of the respective frequency characteristics are in coincidence with those of the frequency characteristic of Rh of the heat generation member viewed from the coil of the fixing apparatus when the heat generation member is actually incorporated into the fixing apparatus. After the adjustment, based on such a state, confirmation as to whether or not a desired heat generation distribution is obtained when the frequency caused to pass through the coil can be made.

(Embodiment 2)

In this embodiment, with respect to the fixation roller as the heating member, a plurality of heat generation member portions which invert their heat generation densities by switching of frequency by means of a frequency control means in a longitudinal direction of the fixation roller perpendicular to a recording material conveyance direction is disposed to constitute the fixation roller.

Figure 9:
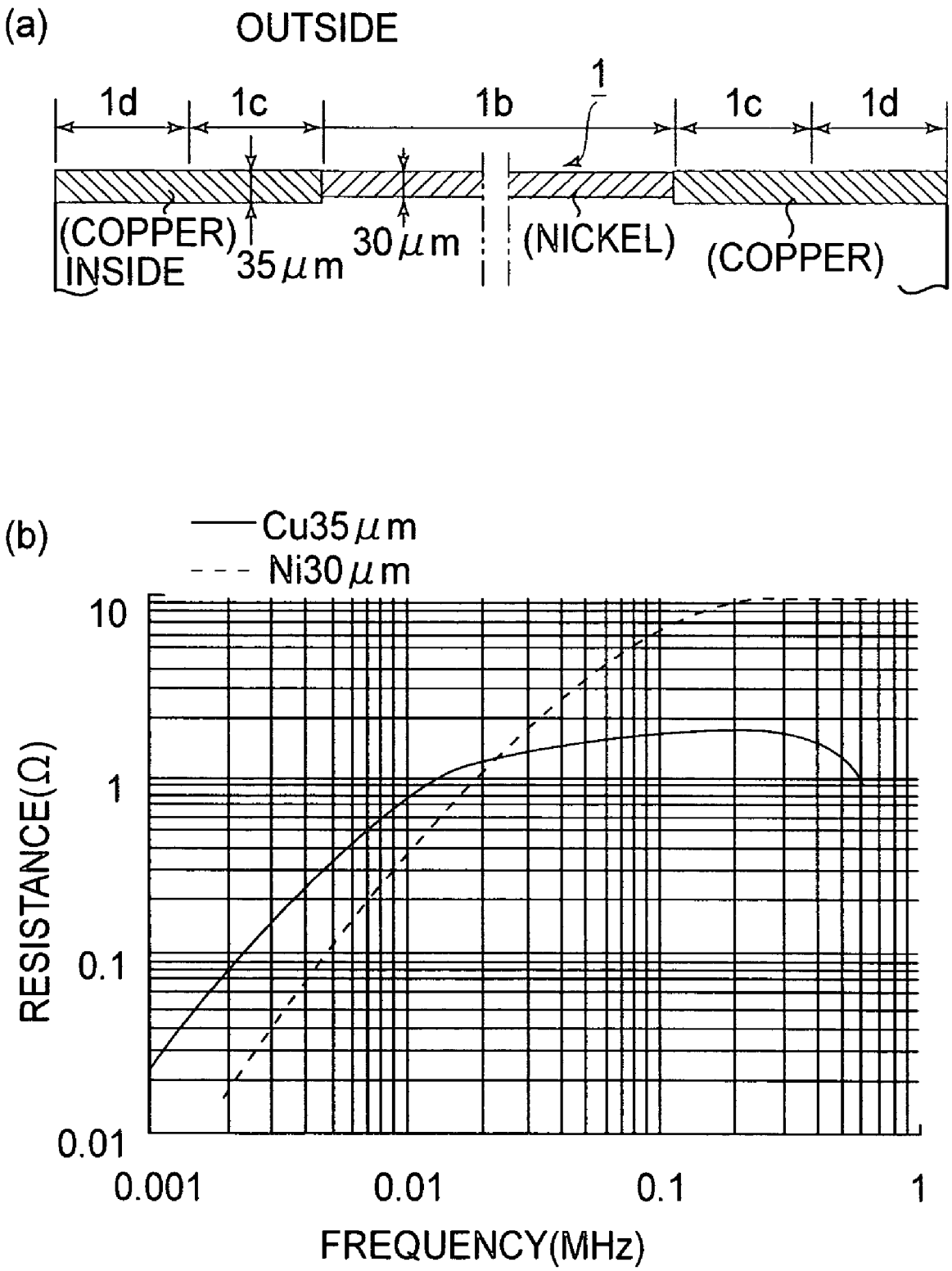
FIGS. 9(*a*) and 9(*b*) are explanatory views showing an embodiment of the fixing roller in Embodiment 2.

More specifically, as shown in FIG. 9(*a*) showing a schematic view of a fixation roller 1 in a longitudinal direction thereof, the fixation roller 1 includes a 30 μm-thick metal layer of nickel as a fixation roller portion 1*b* and 35 μm-thick metal layers of copper as fixation roller portions 1*c* and 1*d*. In other words, the fixation roller portions 1*b*, 1*c*, and 1*d* of the fixation roller 1 are the metal layers which are formed of metal materials different in electroconductivity and thickness between the fixation roller portion 1*b* and the fixation roller portions 1*c* and 1*d*. In this embodiment, the thickness of the fixation roller 1 in the longitudinal direction of the fixation roller 1 is different but may be identical.

FIG. 9(*b*) shows a result of measurement of resistances Rh of magnetic induction heat generation members (of nickel (Ni) and copper (Cu)) which are formed of metal materials different in electroconductivity and thickness.

When the size information of the recording material used for sheet passing inputted from the recording material size selection and designation means 55 in the large-size recording material P1, the main assembly control circuit portion 50 controls the frequency control portion 54 so that the frequency of the alternating current caused to flow from the exciting circuit 51 to the exciting coil 4 is changed to about 20 kHz. As a result, the resistances Rh of the fixation roller portions 1*b* and 1*c* of the fixation roller 1 are substantially identical to each other, and thus heat generation densities of the fixation roller portions 1*b* and 1*c*, of the fixation roller 1, which generate heat due to magnetic induction are also substantially identical to each other, so that it is possible to uniformize heat supply from the fixation roller 1 to the large-size recording material P1 in the longitudinal direction of the fixation roller 1. In other words, it is possible to uniformize a thermal distribution over the entire fixation roller portions 1*b*+1*c* corresponding to the sheet-passing area A of the large-size recording material P1. Further, in the longitudinal direction of the fixation roller 1, the roller end portion causes heat dissipation larger in amount than the central portion, thus being liable to be lowered in temperature. For this reason, the frequency may also be set so that the amount of heat generation at the end portion is larger than that at the central portion.

When the size information of the recording material used for sheet passing inputted from the recording material size selection and designation means 55 in the small-size recording material P2, the main assembly control circuit portion 50 controls the frequency control portion 54 so that the frequency of the alternating current caused to flow from the exciting circuit 51 to the exciting coil 4 is changed to be higher than about 20 kHz. As a result, the resistance Rh of the fixation roller portion 1*c* of the fixation roller 1 is lower than the resistance Rh of the fixation roller portion 1*b*, i.e., a heat generation density of the resistance Rh of the fixation roller portion 1*c* which generates heat due to magnetic induction is smaller than a heat generation density of the fixation roller portion 1*b*, so that the heat generation density corresponding to the non-sheet-passing area can be decreased. As a result, it is possible to suppress temperature rise at the non-sheet-passing portion.

Further, when the temperature is lowered at the fixation roller end portion (the end portion of an entire effective heat generation area of the fixation roller 1 (corresponding to the sheet-passing area A of the large-size recording material P1)), by decreasing the frequency of a current caused to flow from the exciting circuit 51 to the exciting coil 4 so as to be lower than about 20 KHz, the resistance Rh of the fixation roller portion 1*c* is higher than the resistance Rh of the fixation roller portion 1*b*. As a result, a heat generation density at the fixation roller portion 1*c* which generates heat due to magnetic induction is larger than that at the fixation roller portion 1*b*, so that the heat generation density at the fixation roller portion 1*c* disposed in the end portion area can be increased to suppress a lowering in temperature at the fixation roller end portion.

More specifically, the fixation roller 1 formed of different materials in the longitudinal direction thereof is disposed so that an amount of heat generation per unit length in the longitudinal direction of the fixation roller 1 is inverted between the central portion and the end portion in the heat generation area of the fixation roller 1 and the frequency of the current caused to pass through the exciting coil 4 is changed by the frequency control means, whereby it is possible to increase or decrease the amount of heat generation per unit length in the longitudinal direction at the fixation roller end portion relative to the fixation roller central portion. Thus, the temperature at the fixation roller end portion can be controlled and image deterioration due to the temperature lowering at the end portion can be prevented. Further, it is also possible to suppress temperature rise in the non-sheet-passing area of the fixation roller.

Here, the inversion of the amount of heat generation per unit length in the longitudinal direction of the fixation roller means that the amount of heat generation per unit length in the longitudinal direction at the end portion of the fixation roller is reversed (inverted) relative to the amount of heat generation per unit length in the longitudinal direction at the central portion of the fixation roller by switching the frequency of the current. By the inversion, the temperature of the fixation roller at the end portion can be decreased or increased relative to a temperature-controlled value at the central portion.

(Embodiment 3)

Figure 10:
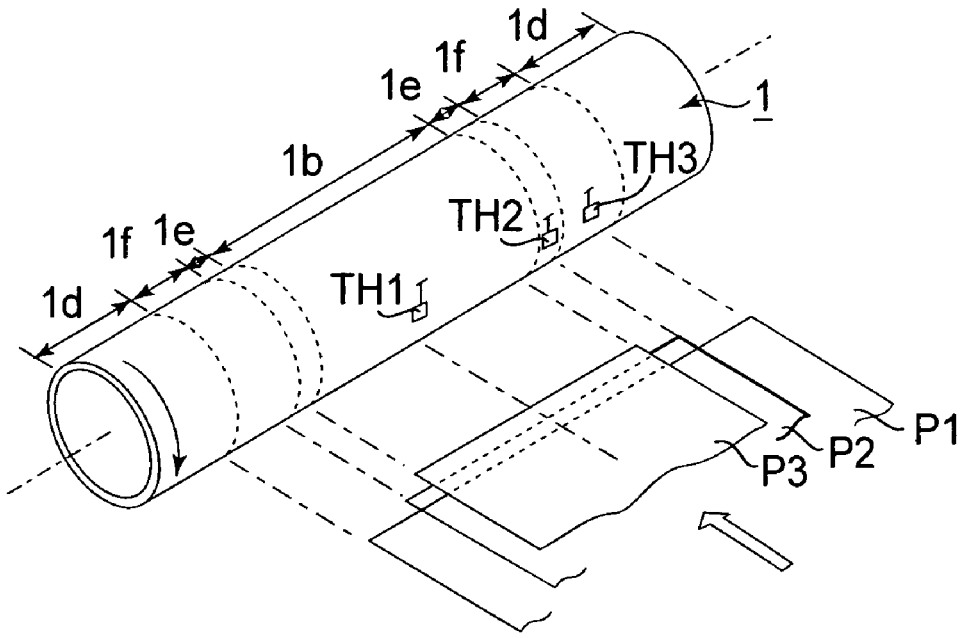
FIG. 10 is an explanatory view of a structure of the fixing roller in Embodiment 3.

In Embodiment 2, the embodiment in which the temperature rise at the non-sheet-passing portion during the sheet passing of the small-size recording material is prevented is described. In this embodiment, however, as shown in FIG. 10, a fixation roller 1 is formed of a plurality of materials different in frequency characteristic of resistance in a longitudinal direction of the fixation roller 1. More specifically, referring to FIG. 10, in the longitudinal direction of the fixation roller 1, the fixation roller 1 includes a fixation roller portion 1*b* corresponding to a sheet-passing area of a small-size recording material P3, a fixation roller portion 1*e* corresponding to an area of a difference between a sheet-passing area of a medium-size recording material P2 and a sheet-passing area of the small-size recording material P3 in the case of passing the medium-size recording material P2 through the fixing apparatus, a fixation roller portion 1*f* (a non-sheet-passing area in the case of passing the medium-size recording material P2 through the fixing apparatus) corresponding to an area of a difference between a sheet-passing area of a large-size recording material P1 and the sheet-passing area of the medium-size recording material P2 in the case of passing the large-size recording material P3 through the fixing apparatus, and an fixation roller extension portion 1*d* located outside the fixation roller portion 1*f*. The fixation roller portion 1*e*+1*f* are fixation roller portions (non-sheet-passing areas in the case of passing the small-size recording material P3) corresponding to areas of a difference between the sheet-passing area of the large-size recording material P1 and the sheet-passing area of the small-size recording material P3 in the case of passing the small-size recording material P3 through the fixing apparatus.

An alternating magnetic field generated in the exciting coil assembly 3 as the magnetic field generation means disposed inside the fixation roller 1 acts on a range of the fixation roller portions 1*b*+1*e*+1*f*. This range (1*b*+1*e*+1*f*) of the fixation roller 1 is a range substantially heated due to magnetic induction heating. On the fixation roller extension portion 1*d*, the alternating magnetic field of the exciting coil assembly 3 does not act substantially. Accordingly, the fixation roller extension portion 1*d* is a non-heating range portion.

In the fixing apparatus, first to third temperature detection elements TH1 to TH3 for detecting the temperature of the fixation roller 1 are provided. These elements are independently disposed in contact or noncontact with the fixation roller 1. More specifically, the first temperature detection element TH1 is disposed at a position corresponding to the fixation roller portion 1*b*, the second temperature detection element TH2 is disposed at a position corresponding to the fixation roller portion 1*e*, and the third temperature detection element TH3 is disposed at a position corresponding to the fixation roller portion 1*f*. Information on the temperatures of the fixation roller 1 detected by these temperature detection elements TH1 to TH3 is inputted into the main assembly control circuit portion 50. The main assembly control circuit portion 50 temperature-controls the fixation roller 1 by controlling power supplied from the exciting circuit 51 to the exciting coil 4 so that the fixation roller temperature inputted from the first temperature detection element TH1 is kept at a predetermined optimum temperature (fixing temperature). In this embodiment, the fixation roller 1 is formed of a plurality of materials different in frequency characteristic of resistance Rh at the fixation roller portion 1*b*, the fixation roller portion 1*e*, and the fixation roller portions 1*f*+1*d*, respectively. The fixation roller 1 is designed so that a heat generation distribution corresponding to each of the respective sizes of the recording material can be obtained by switching the frequency at these portions different in frequency characteristic of Rh.

More specifically, depending on the information on the size width of the recording material to be subjected to sheet passing operation, the plurality of fixation roller portions described above is disposed and the frequency of a current caused to pass through the exciting coil is changed by the frequency control means, whereby it is possible to relatively control the heat generation density in the fixation roller portion area depending on the size of the recording material to be passed through the fixing apparatus. As a result, depending on a plurality of sheet-passing modes, the end portion temperature can be optimized and an optimum power supply can be effected with a good heat generation efficiency. Thus, it is possible to provide an induction heating-type fixing apparatus capable of suppressing the temperature rise in the non-sheet-passing area of the fixation roller.

In Embodiments 1 to 3 described above, the heat generation distribution of the fixation roller in the longitudinal direction of the fixation roller is changed by changing the frequency of the current caused to pass through the exciting coil 4 depending on the recording material size width information. It is also possible to uniformly heat the fixation roller in the longitudinal direction thereof by changing the frequency of the alternating magnetic field in the case where a difference in temperature between the temperatures of the central portion and the end portion of the fixation roller exceeds a predetermined value on the basis of detection results of the first and second temperature detection elements TH1 and TH2 or the first to third temperature detection elements TH1 to TH3.

Further, according to the above described embodiments, a magnetic circuit created between the magnetic field generation means and the fixation roller as the heating member which generates heat due to magnetic induction needs no space for accommodating the magnetic field generation means. Further, the fixing apparatus needs no member having a large heat capacity for facilitating thrust heat conduction, so that energy saving performance cannot be impaired.

Figure 11:
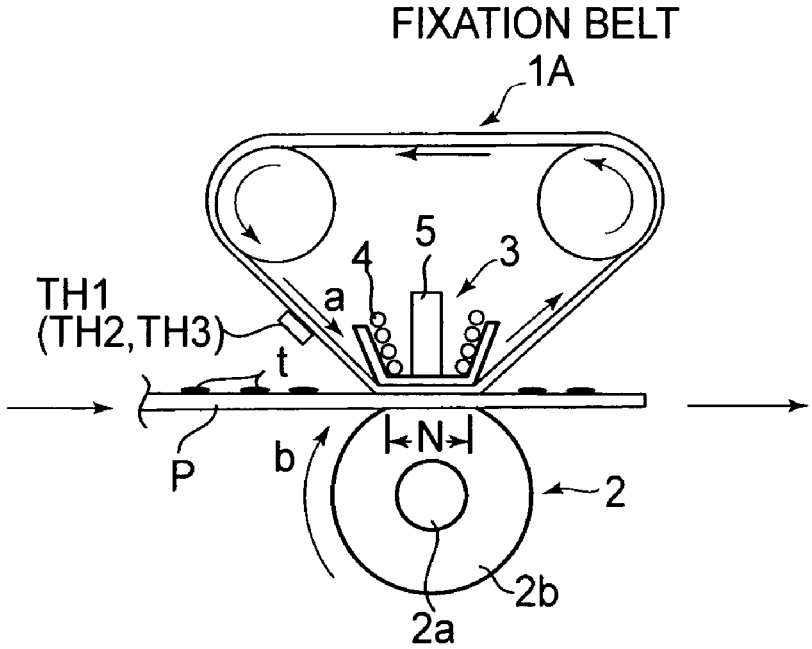
FIG. 11 is a schematic structural view of an embodiment of an image heating apparatus (fixing apparatus) including a heating member formed in a rotational moving belt (fixing belt).

In the above described embodiments, explanation is made by using the fixation roller 1 as the magnetic induction heating-type heating member. However, the shape of the heating member is not limited to the roller shape but may also be a flexible rotational moving belt such as a fixing belt 1A shown in FIG. 11.

Further, in the above described embodiments, the fixing apparatus using the center line based sheet passing of the recording material is described but the present invention is also effectively applicable to a fixing apparatus using one end (edge) line based sheet passing of the recording material.

The image heating apparatus of the present invention can also be used, in addition to the image heating fixing apparatus, as a preliminary fixing apparatus for preliminarily fixing an unfixed image on a recording material or a surface-modifying apparatus for modifying image surface properties such as gloss or the like by re-heating a recording material carrying thereon a fixed image.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 114745/2005 filed Apr. 12, 2005, which is hereby incorporated by reference.

What is claimed is:

1. An image heating apparatus, comprising:

a coil configured to generate magnetic flux by energization;

a heat generation member, having an electroconductive layer which generates heat by magnetic flux, for heating an image on a recording material; and frequency switching means for switching a frequency of a current supplied to said coil, wherein said electroconductive layer comprises a first electroconductive member at a central portion thereof and a second electroconductive member at an end portion thereof, and wherein said first electroconductive member has a resistance characteristic, with respect to the frequency of the current supplied to said coil, different from that of said second electroconductive member.

2. An apparatus according to claim 1, wherein said first electroconductive member has permeability different from that of said second electroconductive member.

3. An apparatus according to claim 1, wherein said first electroconductive member has a first area in which a resistance value of said first electroconductive member is smaller than that of said second electroconductive member with respect to the same frequency and a second area in which a resistance of said first electroconductive member is equal to or larger than that of second electroconductive member with respect to the same frequency.

4. An apparatus according to claim 3, wherein said frequency switching means switches the frequency of the current supplied to said coil to a frequency in a range of the second area when a recording material having a maximum size is passed through said apparatus.

5. An apparatus according to claim 4, wherein said apparatus further comprises a temperature detection member configured and positioned to detect a temperature of a portion corresponding to said first electroconductive member and electric power control means for controlling the electric power supplied to said coil depending on an output of said temperature detection member, and wherein said electric power control means controls the electric power in a range of frequency in the second area.

6. An apparatus according to claim 3, wherein said apparatus further comprises a temperature detection member configured and positioned to detect a temperature of a portion corresponding to said first electroconductive member, and wherein said frequency switching means switches the frequency of the current supplied to said coil to a frequency in a range of the first area.

7. An apparatus according to claim 1, wherein said heat generation member is an image heating member having a release layer at its surface.

8. An apparatus according to claim 1, wherein said first electroconductive member has a thickness substantially equal to that of said second electroconductive member.

* * * * *

UNITED STATES PATENT AND TRADEMARK OFFICE

CERTIFICATE OF CORRECTION

PATENT NO. : 7,208,708 B2
APPLICATION NO. : 11/397682
DATED : April 24, 2007
INVENTOR(S) : Joji Nagahira et al.

It is certified that error appears in the above-identified patent and that said Letters Patent is hereby corrected as shown below:

ON THE TITLE PAGE
At Item (57), Abstract, line 4, “energization” should read --energization,--.
At Item (57), Abstract, line 6, “material and,” should read --material, and--.

IN THE DRAWINGS
Sheet 6, Fig. 7(a), “(ALMINUM)” (both occurrences) should read --(ALUMINUM)--.

COLUMN 2
Line 4, “generating applying a” should be deleted.
Line 5, “magnetic field generation means for generating” should be deleted.

COLUMN 4
Line 23, “which an” should read --which is an--.

COLUMN 5
Line 28, “assembly 3 an” should read --assembly 3 is an--.
Line 35, “gap a” should read --gap α--.

COLUMN 9
Line 58, “Meat” should read --heat--.

COLUMN 11
Line 25, “thickness in” should read --thickness is--.
Line 58, “materials only have to” should read --materials, only has to--.

UNITED STATES PATENT AND TRADEMARK OFFICE

CERTIFICATE OF CORRECTION

PATENT NO. : 7,208,708 B2
APPLICATION NO. : 11/397682
DATED : April 24, 2007
INVENTOR(S) : Joji Nagahira et al.

It is certified that error appears in the above-identified patent and that said Letters Patent is hereby corrected as shown below:

COLUMN 12
Line 22, "caused" should read --is caused--.

COLUMN 14
Line 26, "portion" should read --portions--.

Signed and Sealed this

Twentieth Day of May, 2008

JON W. DUDAS
*Director of the United States Patent and Trademark Office*